US011577529B2

(12) United States Patent
Luid Pinol et al.

(10) Patent No.: US 11,577,529 B2
(45) Date of Patent: Feb. 14, 2023

(54) MEDIA EDGE LIFTING

(71) Applicant: HEWLETT-PACKARD DEVELOPMENT COMPANY, L.P., Spring, TX (US)

(72) Inventors: Nestor Luid Pinol, Sant Cugat del Valles (ES); Marta Blanch Pinol, Sant Cugat del Valles (ES); Anna Tarradas Juan, Sant Cugat del Valles (ES)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 163 days.

(21) Appl. No.: 17/204,128

(22) Filed: Mar. 17, 2021

(65) Prior Publication Data

US 2022/0297452 A1 Sep. 22, 2022

(51) Int. Cl.
*B41J 11/42* (2006.01)

(52) U.S. Cl.
CPC ..... *B41J 11/42* (2013.01)

(58) Field of Classification Search
CPC ..... B41J 11/42; B41J 11/003; B41J 11/0035; B41J 13/26; B41J 11/007
See application file for complete search history.

(56) References Cited

U.S. PATENT DOCUMENTS

| | | | | |
|---|---|---|---|---|
| 6,042,103 | A | 3/2000 | Yraceburu et al. | |
| 6,672,696 | B2 | 1/2004 | Fairchild et al. | |
| 7,549,636 | B2 | 6/2009 | Schmid et al. | |
| 7,645,006 | B2 | 1/2010 | Schalk et al. | |
| 9,233,807 | B2 | 1/2016 | Lo et al. | |
| 2008/0238959 | A1* | 10/2008 | Kato | B41J 29/38 347/8 |

* cited by examiner

*Primary Examiner* — Justin Seo

(57) ABSTRACT

In one example in accordance with the present disclosure, a media lifting device is described. The media lifting device includes a media lifting strip to sit on a media transport belt of a printing system. The media lifting strip is to raise a lateral edge of incoming media. That lateral edge of incoming media is a portion of the incoming media that is parallel to a media travel direction. The media lifting device also includes a clamp to affix the media lifting strip to the printing system.

15 Claims, 13 Drawing Sheets

MEDIA EDGE LIFTING

BACKGROUND

Printing systems are used for precisely, and rapidly, dispensing small quantities of fluid, such as ink, onto media, such as paper. Such printing devices come in many forms. For example, a printing system may include a media transport belt that moves media underneath a printing device which deposits a print agent onto the media.

BRIEF DESCRIPTION OF THE DRAWINGS

The accompanying drawings illustrate various examples of the principles described herein and are part of the specification. The illustrated examples are given merely for illustration, and do not limit the scope of the claims.

Figure 1:
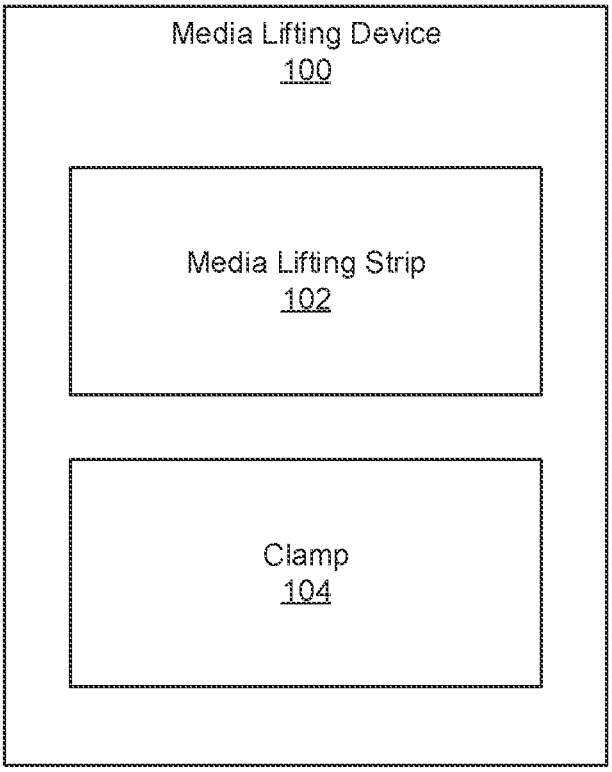
FIG. 1 is a block diagram of a media lifting device, according to an example of the principles described herein.

Throughout the drawings, identical reference numbers designate similar, but not necessarily identical, elements. The figures are not necessarily to scale, and the size of some parts may be exaggerated to more clearly illustrate the example shown. Moreover, the drawings provide examples and/or implementations consistent with the description; however, the description is not limited to the examples and/or implementations provided in the drawings.

DETAILED DESCRIPTION

Printing may involve the deposition of a print agent, such as ink, toner, or the like on a substrate in a pattern to form text and/or images. Different kinds of printers implement different devices to print. For example, some desktop printers use rollers and the like to move the media under a scanning carriage. Affixed to the scanning carriage are any number of printheads which dispense the print agent.

Another example of a printing system is a belt printer, wherein the media is positioned on a media transport belt, which may be rubberized. Motors coupled to the media transport belt move the belt along a circular path. The media to be printed on is placed on the media transport belt. This media transport belt moves the media under a scanning carriage along which a printhead travels in a direction perpendicular to the media travel path. A controller of the printing system directs the printhead to eject print agent at predetermined times to form text and/or images on the media.

In a particular example, such a belt printing system may operate in a production mode where a user desires to print several copies of the same text and/or images on sheets of media that have the same dimensions. For example, a user may desire to print a particular graphic on a sheet of media, and may desire to replicate this graphic on multiple sheets of media. Such a workflow reduces the overall print time as certain operations such as media measurement occur just for a first sheet of media and not on subsequent sheets of media.

However, in a belt printing system, it may be desirable to block a subsequent sheet of media to ensure it does not enter the print zone before desired. That is, the media transport belt may continuously move such that the printhead can deposit additional lines of the text and/or image. Accordingly, any additional sheet placed on the media transport belt would also move. Accordingly, when printing multiple instances of a print job, the belt printer may include a component to stop the second sheet of media from entering a print zone until the printer is ready to accept the second sheet. In a particular example, this blocking device may be a mechanical block that is lowered to interact with the media to prevent it from entering a print zone. The blocking device also provides a registration surface against which media may be pushed such that the media enters the print zone in an aligned orientation without skew.

In general, the workflow for a production mode printing operation on a belt printing system may include registering a first sheet of media by tapping it against a blocking device in a direction of media travel and against a lateral reference in a direction perpendicular to the media travel direction.

The media dimensions may then be measured. For example, the media transport belt may advance the media until it is underneath the blocking device. The blocking device may then be lowered until it contacts the media. Based on this measured thickness, the printing system may move the printhead carriage beam such that the printhead is a desired distance away from the media during printing.

The media transport belt may further advance the media until it is underneath the scanning carriage. Sensors on the scanning carriage may detect the edges of the media and the position of the media. Note that these measurements may be performed just for the first sheet of the media. That is, as subsequent sheets of media have the same dimensions, measurement of a thickness and width of subsequent sheets of media may be alleviated.

Following registration and measurement, the printing components, i.e., the printhead of the printing system, may deposit the print agent to generate a first physical copy of the text and/or images on the first sheet of media. Specifically, the media transport belt may advance the media in a media travel direction. As the media advances in the media travel direction, the printhead traverses over the media in a direction orthogonal to the media travel direction. As it traverses over the media, the printhead deposits print agent to form the text and/or images. Once the entirety of the first sheet of media passes the blocking device, the blocking device lowers in order to 1) allow the registration of a subsequent media sheet and 2) prevent the subsequent media sheet from entering the print zone while the first sheet is being printed. Were the second sheet to pass into the print zone, it may inadvertently cover a portion of the first sheet, which may impact print agent deposition and any resultant image and/or text.

While the first sheet of media is being printed, a user may place a second sheet of media on the media transport belt and register it against the blocking device system and the lateral reference. Once the printing of the first media sheet is finished, the blocking device may be raised such that the second sheet may enter the print zone and be printed on.

Such a production mode may allow a user to perform certain calibration operations, such as measuring dimensions of the media, a single time. However, it may be that such a printing system does not facilitate printing on thin media. That is, to avoid friction and mechanical damage to the media transport belt, the blocking device may be maintained at a position such that there is a gap between the media transport belt and the blocking device. In some examples, the gap may be 0.8 millimeters (mm). Accordingly, a media sheet less than 0.8 mm thick may not interface with the blocking device and may slide underneath the blocking device and enter the print zone at a time when it is not intended and undesired.

Accordingly, the present specification describes a media lifting device and printing system that allows a belt printing system to print on thin media, regardless of a gap between the blocking device and media transport belt being greater than the thickness of the media. Specifically, the media lifting device raises the lateral edges of the media such that these raised edges contact the blocking device and do not unintentionally pass under the blocking device into the print zone.

Specifically, the media lifting device includes at least two components. A clamp affixes a media lifting strip to the printing system, at for example the loading table of the printing system. The clamp locates the media and holds the second component of the printing system which is the media lifting strip. Lateral edges of the media rest on the media lifting strip such that they interface with the blocking device. When the blocking device is down, the media lifting strip is below the blocking device with a gap of, for example 0.1 mm. When resting on the media lifting strip, the media contacts the blocking device preventing the media from sliding into the print zone. When the blocking device is raised, the media is passed, via action of the media transport belt, to the print zone. In an example, the media lifting strip may not pass into the print zone, such that when the media enters to the print zone, the edges are no longer on top of the media lifting strip and are not raised, thus ensuring print quality. That is, were the edges of media raised during printing, print quality may be reduced and distortion in the printed text and/or images may be introduced.

Specifically, the present specification describes a media lifting device. The media lifting device includes a media lifting strip to sit on a media transport belt of a printing system. The media lifting strip is to raise a lateral edge of incoming media. In this example, the lateral edge is a portion of the media that is parallel to a media travel direction. The media lifting device also includes a clamp to affix the media lifting strip to the printing system.

The present specification also describes a method. According to the method, a media transport belt transports a first sheet of media towards a print zone of a printing system. The first sheet of media is registered and measured as it enters the print zone. Lateral edges of a second sheet of media are raised to interface with a blocking device of the printing system to block the second sheet of media from entering the print zone while the first sheet of media is being printed on.

The present specification also describes a printing system. The printing system includes a loading table to receive sheets of media to be printed on and a printing device to deposit a print agent onto the sheets of media. The sheets of media to be printed on sit on a media transport belt which moves the sheets of media underneath the printing device. The printing system also includes a blocking device that is moveable to 1) prevent a second sheet of media from passing into a print zone while a first sheet is being printed and 2) allow the second sheet of media to pass into the print zone when the first sheet has been completed. In this example, a gap is maintained between the blocking device and the media transport belt. The printing system also includes a media lifting device. The media lifting device includes a media lifting strip to sit on the media transport belt and to raise a lateral edge of incoming media such that the media interfaces with the blocking device and a clamp to affix the media lifting strip to the loading table.

Such devices and methods 1) allow for efficient printing of multiple copies of a print job; 2) allow use of a belt printing system on media that may be less thick than a gap between a blocking device and the media transport belt; 3) may be adjustable to simultaneously print any number of instances; and 4) may be adjustable to media of different dimensions. However, it is contemplated that the systems and methods disclosed herein may address other matters and deficiencies in a number of technical areas.

Turning now to the figures, FIG. 1 is a block diagram of a media lifting device (100), according to an example of the principles described herein. As described above, the media lifting device (100) is to lift a lateral edge of the sheets of media such that sheets are blocked from entering the print zone as a previous sheet of media is being printed on. Otherwise, the second sheet of media may enter the print zone and negatively impact the deposition of the print agent on the previous sheet. Accordingly, the media lifting device (100) may include a media lifting strip (102) that sits on a media transport belt of a printing system. The media lifting strip (102) is to raise a lateral edge of incoming media sheets such that the media interfaces with a blocking device of the printing system. The media lifting strip (102) may be formed of metal or plastic and may be flexible.

Figure 4:
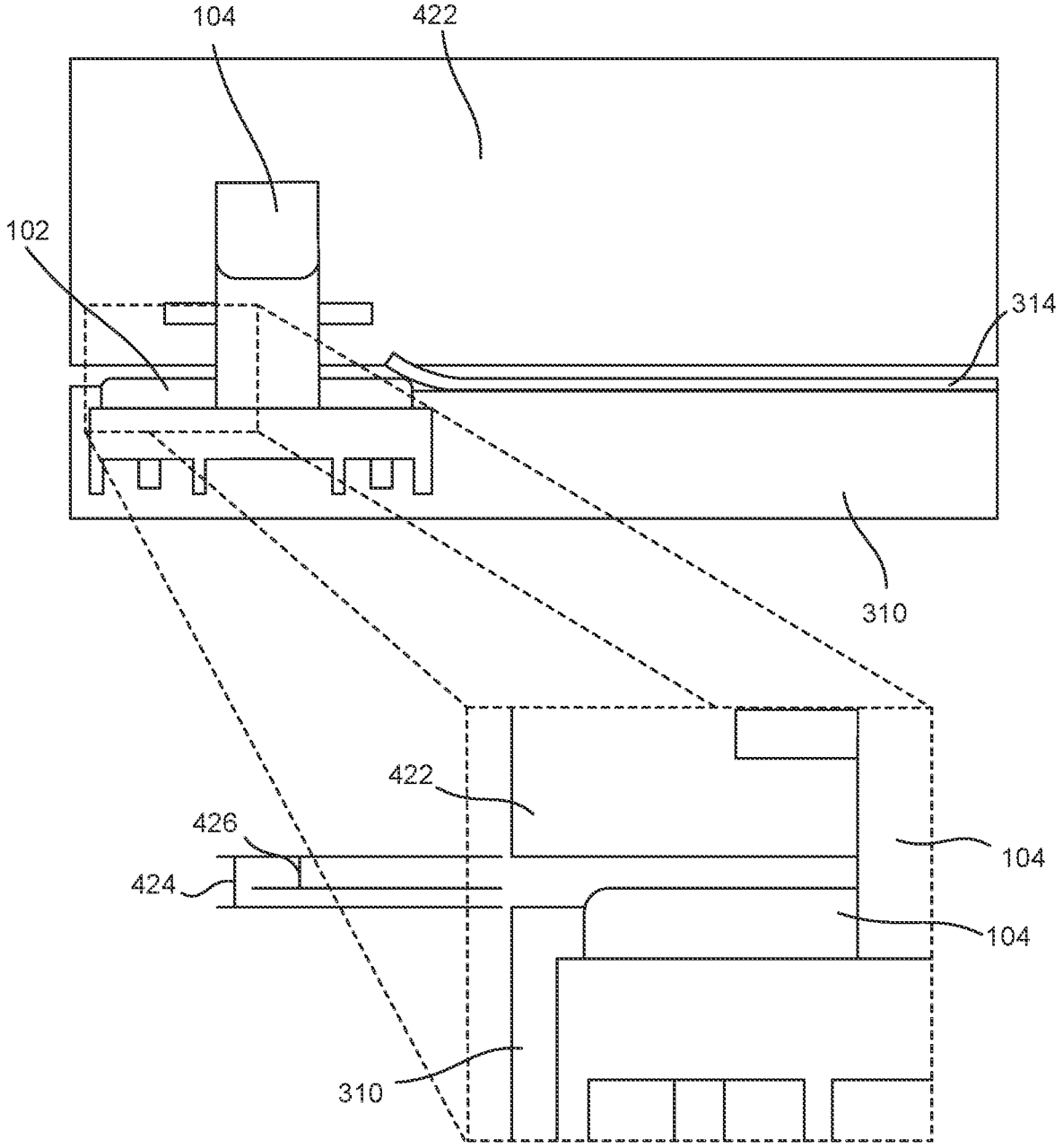
FIG. 4 is a front view of the media lifting device, according to an example of the principles described herein.

The media lifting strip (102) may sit directly on the media transport belt and may extend under a portion of the media. That is, just the edges of the media may sit on the media transport belt while a central portion of the media rests on the media transport belt. As a result of just the edge portions resting on the media lifting device, just the edge portions are raised. This induces a slight curl at the edges of the media. FIG. 4 depicts such an example. In this example, while flat-lying media may fit under a gap between the blocking device and the media transport belt, due to the raised lateral edges, this raised region of the media may interface with the blocking device such that media that would otherwise pass underneath the blocking device, is prevented from entering the print zone.

Figure 7:
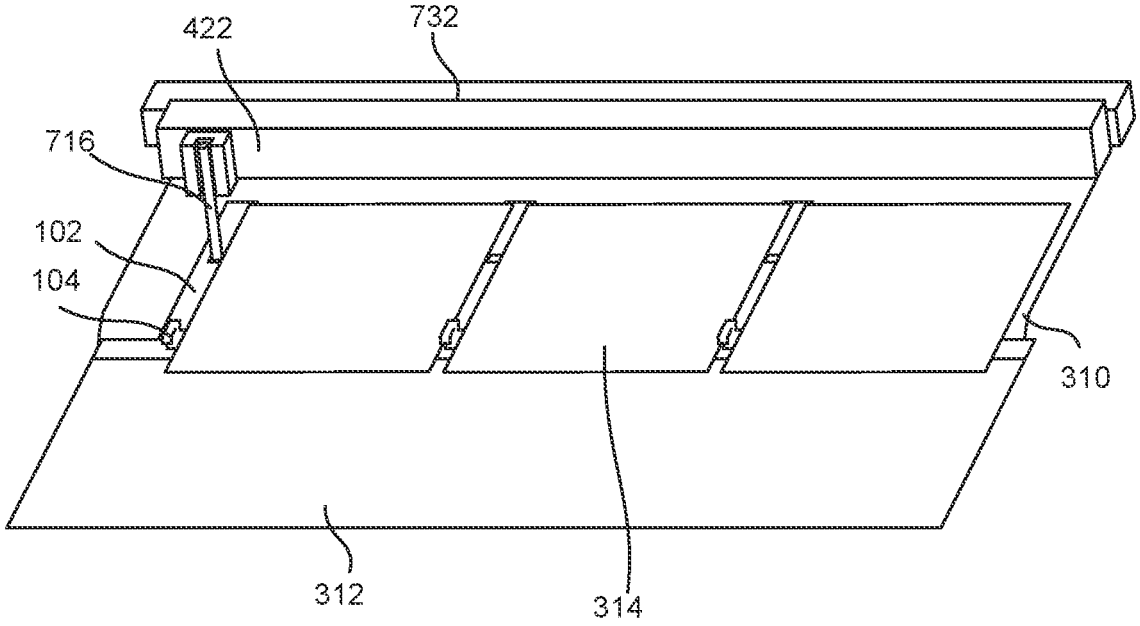
FIG. 7 is a zoomed-in isometric view of a loading table of a printing system with a media lifting device, according to an example of the principles described herein.

The media lifting device (100) may also include a clamp (104) to affix the media lifting strip (102) to the printing system. That is, the media lifting strip (102) may be a separate physical structure from other structures of the printing system. The clamp (104) allows the media lifting strip (102) to be coupled to the printing system. In one particular example, the clamp (104) affixes the media lifting strip (102) to a loading table of the printing system. In some examples, the media lifting device (100) may be re-positioned across the loading table. For example, as depicted in FIG. 7, the media lifting device (100) may be re-positioned along the loading table to accommodate media of different widths.

Figure 2:
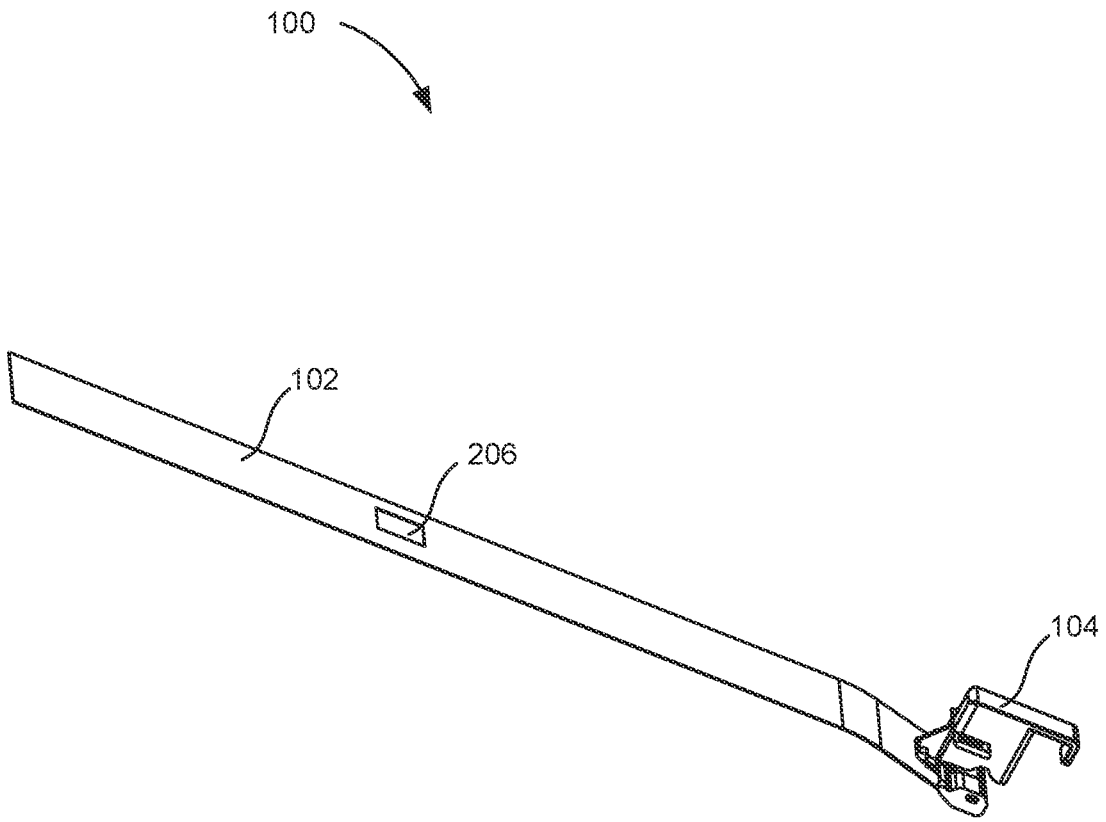
FIG. 2 is an isometric view of a media lifting device, according to an example of the principles described herein.
Figure 12:
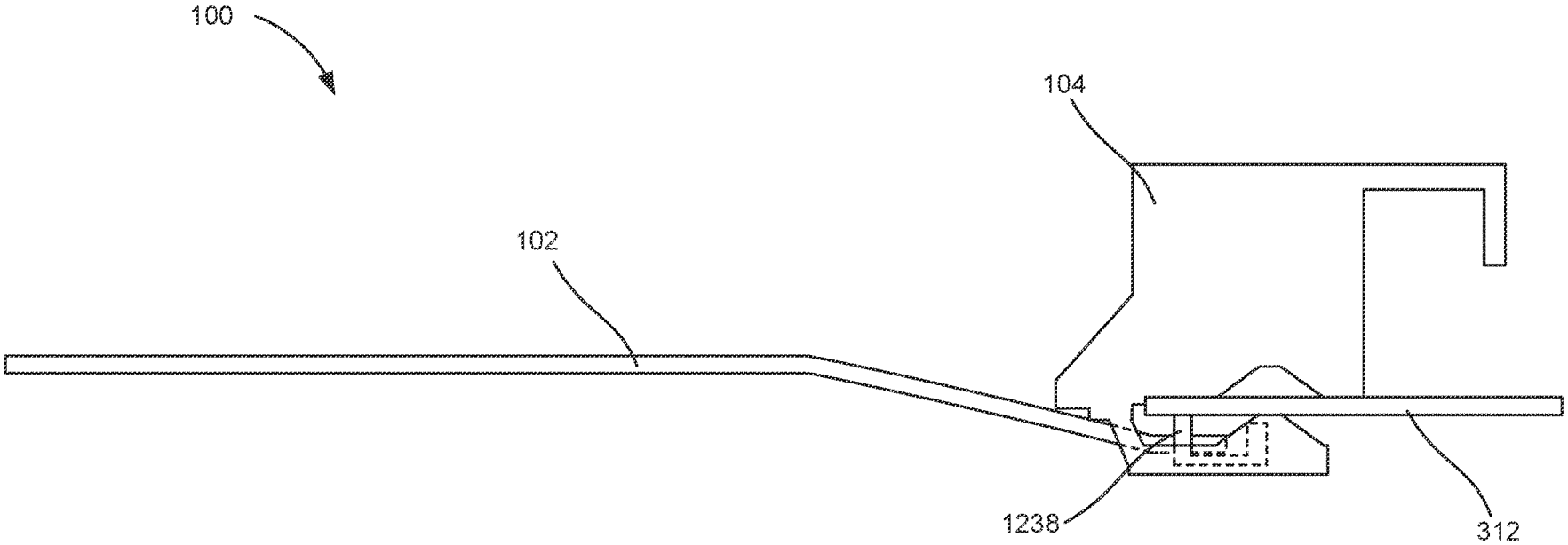
FIG. 12 is a side view of the media lifting device, according to an example of the principles described herein.

FIG. 2 is an isometric view of a media lifting device (100), according to an example of the principles described herein. As described above, the media lifting strip (102) may be an elongated strip of material on which just lateral edges of the media rest and are thus raised. The media lifting strip (102) may include an attachment device to couple the media lifting strip (102) to the clamp (104). For example, the attachment device may include apertures in the media lifting strip (102) that receive posts of the clamp (104). FIG. 12 depicts an example attachment device.

Figure 3:
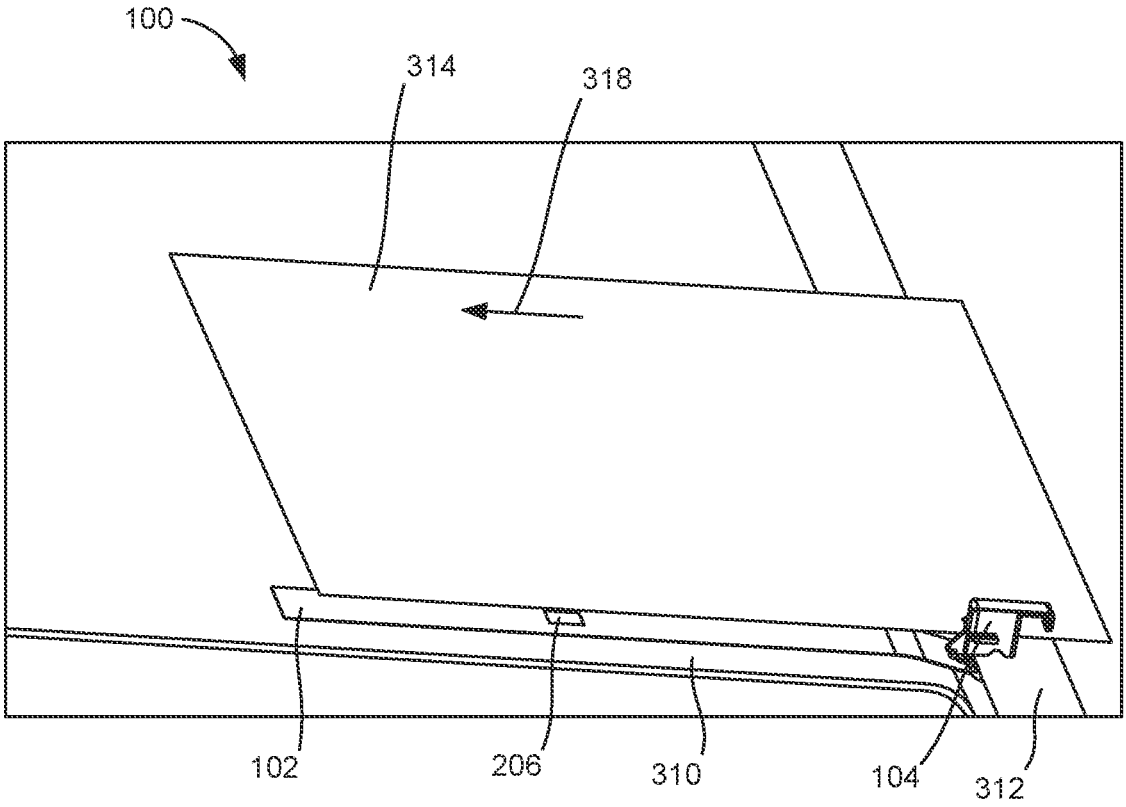
FIG. 3 is an isometric view of a media lifting device as it is disposed on a printing system, according to an example of the principles described herein.

In an example, the media lifting strip (102) includes an aperture (206) to allow passage of a lateral registration device. That is, as described above, the sheet of media may be registered to ensure proper alignment of the text and/or images on the media. This may include tapping the media against a lateral registration device to register the media in a direction parallel to the media travel direction. In an example, the media lifting strip (102) includes an aperture (206) to allow the lateral registration device to be in a position where the media may contact it. FIG. 3 below depicts an example of the lateral registration device projecting into the aperture (102).

FIG. 3 is an isometric view of a media lifting device (100) as it is disposed on a printing system, according to an example of the principles described herein. Specifically, FIG. 3 depicts the media lifting device (100) as it is affixed, via the clamp (104), to a loading table (312) of a printing system. As described above, the media lifting strip (102) rests on the media transport belt (310) and the media transport belt (310) advances in a direction indicated by the arrow (318) to advance the media (314) in the same direction.

FIG. 3 also depicts the loading table (312) to which the clamp (104) is affixed. As described above, the clamp (104) may be positioned at any location along the length of the loading table (312) to accommodate different sizes of media.

Figure 10:
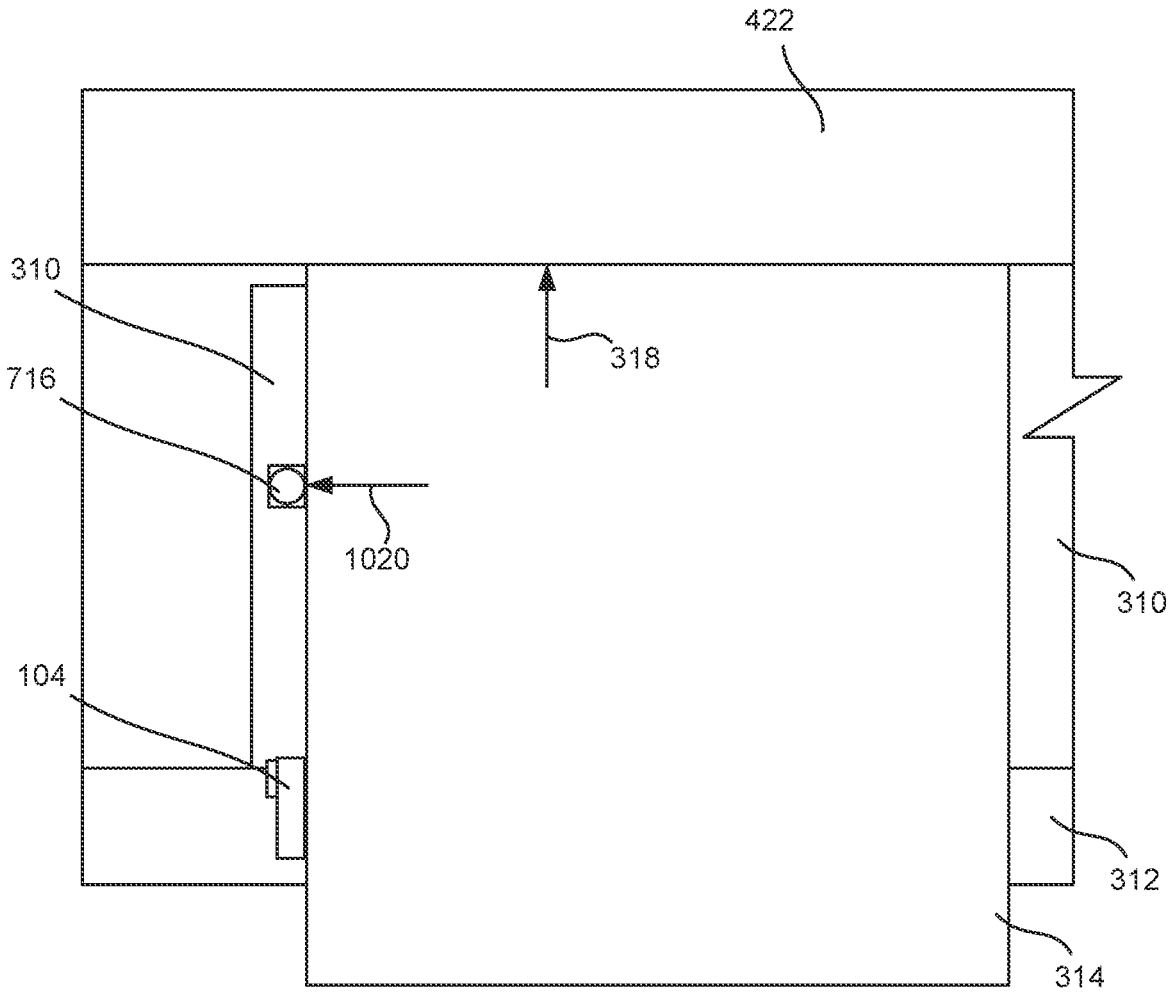
FIG. 10 is a top view of the registration of a sheet of media, according to an example of the principles described herein.

FIG. 3 also depicts the aperture (206) into which a lateral registration device is lowered. As described above, the media (314) may be registered in a direction perpendicular to the media travel direction, by tapping the media (314) against the lateral registration device. FIG. 10 below illustrates the registration of a sheet of media (314) as described herein.

FIG. 4 is a front view of the media lifting device (FIG. 1, 100), according to an example of the principles described herein. Specifically, FIG. 4 depicts the media (314) as it sits on the media lifting strip (102). As depicted in FIG. 4, the nature of just the edges of the media (314) sitting on the media lifting strip (102) raises just the edges of the media (314) such that they interface with a blocking device (422) of the printing system. That is, were the media (314) to be flush with the media transport belt (310), the media (314) may slide underneath the blocking device (422) into the print zone. However, the raised edges of the media (314), generated on account of sitting the edges on the media lifting strip (102), interface with the blocking device (422) such that the media (314) does not pass underneath.

In an example, a gap (424) may be maintained between the blocking device (422) and the media transport belt (310), which gap may be 0.8 mm. Such a gap (424) prevents damage to the media transport belt (310) and/or the blocking device (422). That is, were the media transport belt (310) and the blocking device (422) to touch, friction and other mechanical forces may cause mechanical damage to either component. Accordingly, the gap (424) prevents the physical contact of these components to alleviate any damage that may result from physical contact.

However, media (314) that is thinner than this gap (424) distance may pass underneath the blocking device (422) into the print zone. Accordingly, a gap (426) between the blocking device (422) and the media lifting strip (102) may be less, for example 0.1 mm. Accordingly, the media lifting strip (102) that lifts the media (314) edge by 0.1 mm promotes a blocking interface between the media (314) and the blocking device (422) when the blocking device (422) is in a lowered position, such as when a previous media sheet is being printed on. Note that the gaps (424, 426) and other components depicted in FIG. 4 and others may not be drawn to scale, but may be enlarged to show detail.

Figure 5:
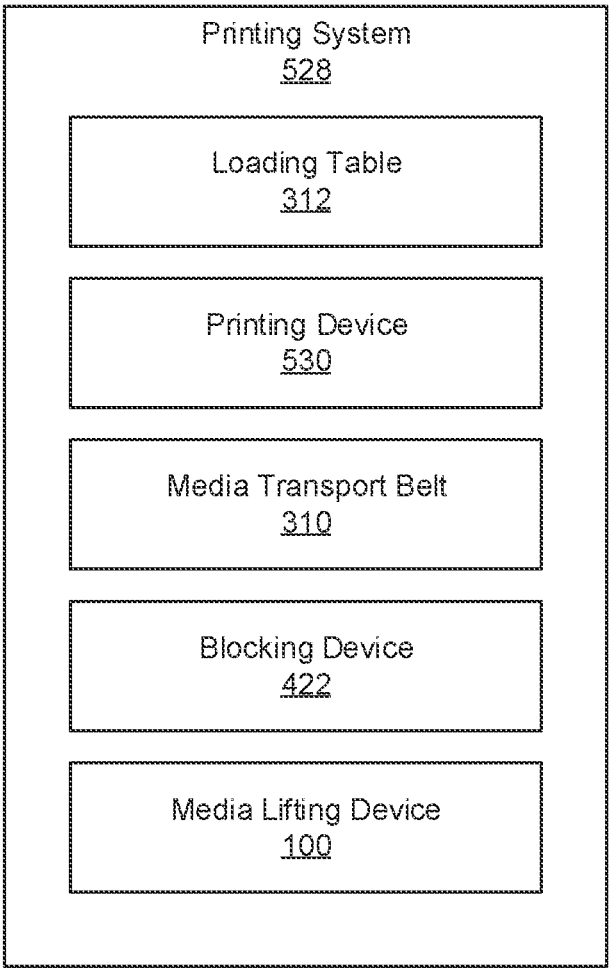
FIG. 5 is a block diagram of a printing system with a media lifting device, according to an example of the principles described herein.

FIG. 5 is a block diagram of a printing system (528) with a media lifting device (100), according to an example of the principles described herein. As described above, the printing system (528) may include components to deposit a print agent onto media (FIG. 3, 314) and to move the media (FIG. 3, 314) into a position such that the print agent may be deposited thereon.

Figure 6A:
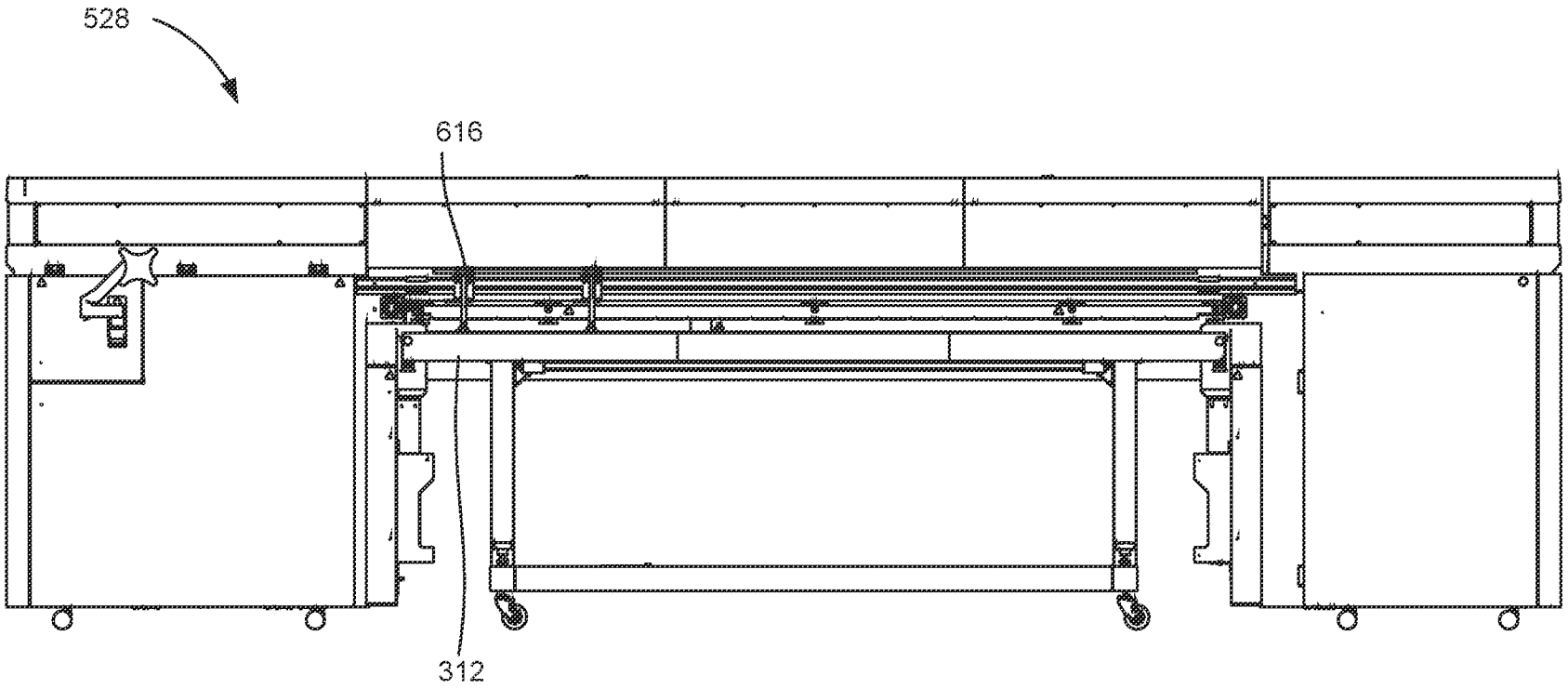
FIGS. 6A and 6B are views of a printing system with a media lifting device, according to an example of the principles described herein.
Figure 6B:
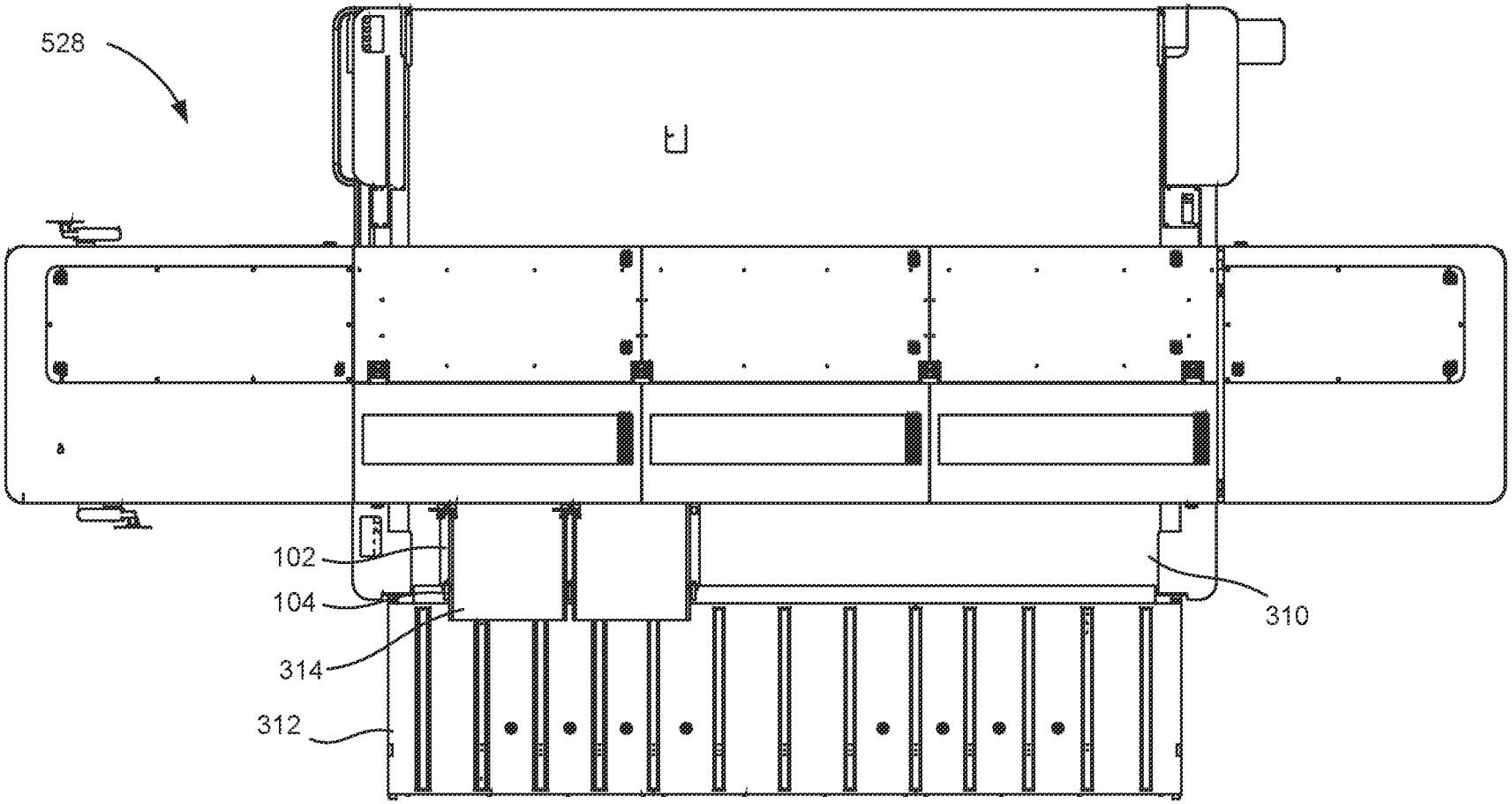

Specifically, the printing system (528) may include a loading table (312) that receives the media (FIG. 3, 314) to be printed on. In some examples, the loading table (312) may be a flat surface that is adjacent the media transport belt (310). FIGS. 6A, 6B, and 7 below depict examples of a loading table (312).

The printing system (528) may also include a printing device (530) to deposit a print agent onto the sheets of media (FIG. 3, 314). In general, the printing device (530) may include the print agent distribution system which ejects the print agent such as ink, toner, or the like onto the media (FIG. 3, 314) and may also include hardware components such as motors, and controllers to facilitate the movement of the print agent distribution system. The print controller may receive instructions from a computing device regarding the text and/or images to print and may operate the print agent distribution system based on the received instructions. As a particular example, the print controller may control the operation of scanning carriages that hold printheads and may also control the fluid ejection components of the printheads.

In an example, the print agent distribution system may include print heads (for example, inkjet or bubble jet print heads), printing drums or plates, or the like. The print agent distribution system may for example include an electrophotographic printing apparatus (including liquid electrophotographic printing apparatus). In some examples, the print agent distribution system may be a scanning print agent distribution system (i.e., a print head makes printing passes relative to a substrate). In this example, the printing device (530) includes a motor and other hardware components to slide the printhead and carriage along carriage rods that are over the print zone. Accordingly, as media (FIG. 3, 314) passes underneath the print zone in a media travel direction, the motors move the printhead along carriage rods that run perpendicular to the media travel direction. At various points in time, the print controller activates the printhead components to eject the print agent in particular patterns to form the text and/or images.

In some examples, the print agent distribution system includes at least one liquid ejection device to distribute a print agent. A liquid ejection device may include at least one printhead (e.g., a thermal ejection based printhead, a piezoelectric ejection based printhead, etc.).

The printing system (528) also includes a media transport belt (310) on which the sheets of media (FIG. 3, 314) sit, and which is to move the sheets of media (FIG. 3, 314) underneath the printing device (530). That is, the media transport belt (310) may be coupled to motors which advance a continuous belt along a continuous path. Media (FIG. 3, 314) sitting on that continuous belt is advanced as the media transport belt (310) rotates.

The printing system (528) also includes a blocking device (422). The blocking device (422) has two positions. In a first, which is down, the blocking device (422) prevents a second sheet of media (FIG. 3, 314) from passing into a print zone while a first sheet is being printed. While in the first position, the blocking device (422) may also provide a registration surface to align the media prior to entry into the print zone. That is, it may be the case that manual loading of the media (FIG. 3, 314) may be improperly aligned such that any text and/or images may be improperly aligned on the media (FIG. 3, 314). Accordingly, the blocking device (422) may ensure proper alignment of the media (FIG. 3, 314) such that text and/or images is printed as intended on the media (FIG. 3, 314). FIG. 10 depicts an example of using the blocking device (422) as a registration surface.

In the second position, which is up, the blocking device (422) allows the second sheet of media (FIG. 3, 314) to pass into the print zone when the first sheet has been completed. As such, the printing system (528) may also include motors that raise and lower the blocking device (422). That is, the blocking device (422) may be a physical component that lowers and raises based on a printing cycle to either restrict or allow transport of the media (FIG. 3, 314) to a print zone to receive print agent from the printing device (530). The raising and lowering of the blocking device (422) may be controlled by a controller of the printing system (528). For example, the printing system (528) may include sensors which indicate when a first sheet of media has passed the blocking device (422). Based on an output of these sensors, motors may lower the blocking device (422) to a blocking position.

The printing system (528) also includes the media lifting device (100) which as described above includes a media lifting strip (FIG. 1, 102) and clamp (FIG. 1, 104) to raise a lateral edge of the media (FIG. 3, 314) such that the raised edge interfaces with, and is blocked by, the blocking device (422).

FIGS. 6A and 6B are views of a printing system (528) with a media lifting device (100), according to an example of the principles described herein. Specifically, FIG. 6A is a front view of the printing system (528) and FIG. 6B is a top view of the printing system (528). FIGS. 6A and 6B depict the loading table (312) onto which media (314) is set and directed onto the media transport belt (310). FIGS. 6A and 6B also depict the media lifting strips (102) and the clamps (104) that are used to raise lateral edges of the media (314) such that they interface with a blocking device (FIG. 4, 422) as a previous sheet is being printed on. For simplicity, a few instances of repeated components are indicated with reference numbers. For example, while FIGS. 6A and 6B depict multiple media lifting strips (102) and multiple clamps (104), just one instance of each is indicated with a reference number.

FIG. 7 is a zoomed-in isometric view of a loading table (312) of a printing system (FIG. 5, 528) with a media lifting device (FIG. 1, 100), according to an example of the principles described herein. FIG. 7 also depicts the scanning carriage (732) to which the printing device (FIG. 5, 530) is coupled for translation along the perpendicular axis to deposit lines of text and/or image.

As depicted in FIG. 7, the printing system (FIG. 5, 528) may include multiple media lifting strips (102) and clamps (104). That is, it may be desirable to simultaneously print on multiple sheets of media (314). As depicted in FIG. 7, media lifting strips (102) and clamps (104) may be positioned on either side of a sheet of media (314) such that both lateral edges of the media (314) are raised to interface with the blocking device (422). Accordingly, the multiple instances of the media lifting strips (102) and clamps (104) facilitate simultaneously lifting multiple sheets of media (314) to block them from entering into the print zone where multiple instances of previous sheets of media (314) may actively be printed on. For simplicity in FIG. 7, a single instance of a clamp (104), media lifting strip (102), and sheet of media (314) are indicated with reference numbers.

In such an example, the printing system (528) may further include a lowerable lateral registration device (716), per media lifting strip (102). That is, for each media lifting strip (102), a lateral registration device (716) may be lowered into a corresponding aperture (FIG. 2, 206), again facilitating the processing of multiple sheets of media (314) in parallel.

In these examples, the clamps (104) and therefore the media lifting device (FIG. 1, 100) in general, is moveable along the loading table (312) of the printing system (528). For example, the clamps (104) may be press fit, or attached via some attachment device such as a setscrew, to the loading table (312).

Figure 8:
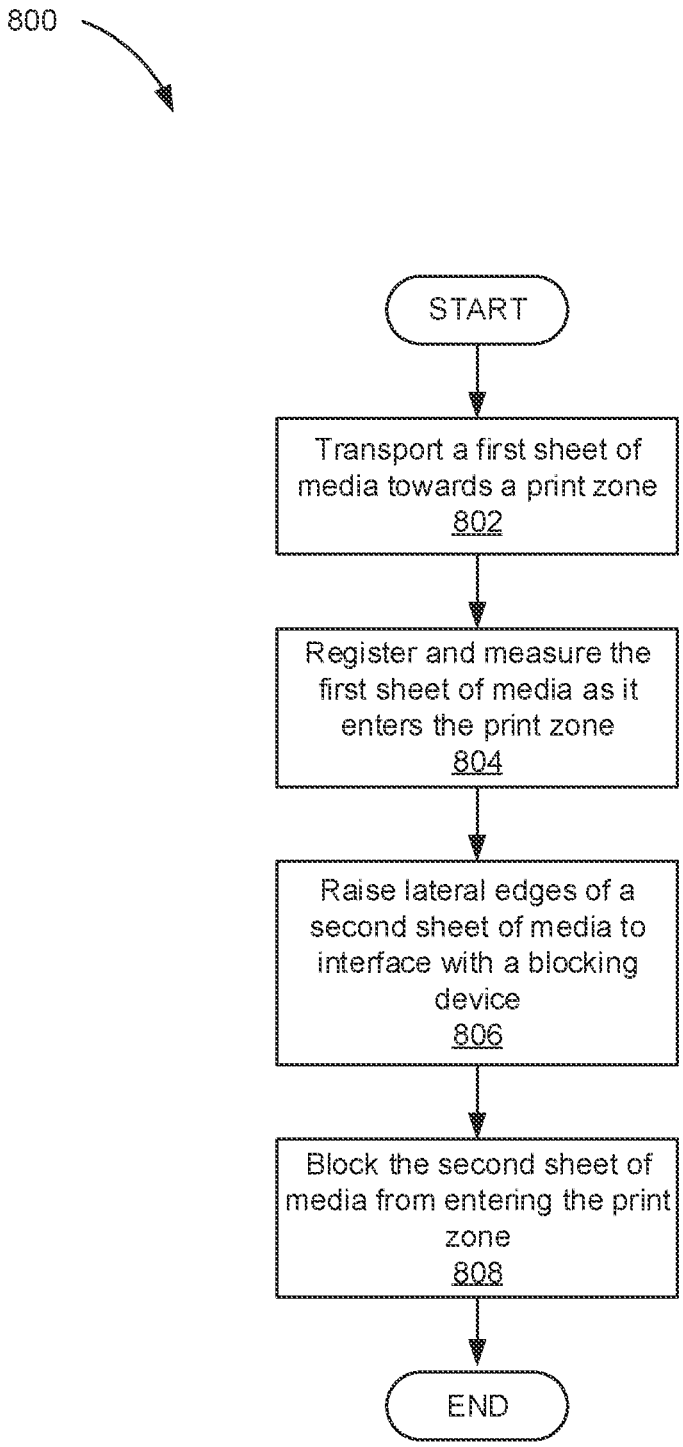
FIG. 8 is a flow chart of a method for lifting edges of media, according to an example of the principles described herein.

FIG. 8 is a flow chart of a method (800) for lifting edges of media (FIG. 3, 314), according to an example of the principles described herein. According to the method (800), a first sheet of media (FIG. 3, 314) is transported (block 802) towards a print zone of a printing system (FIG. 5, 528). That is, the printing system (FIG. 5, 528) may include a printing device (FIG. 5, 530) that traverses a perpendicular axis of the printing system (FIG. 5, 528) to selectively deposit print agent to form text and/or images on the media (FIG. 3, 314). The region underneath the printing device (FIG. 5, 530) where the printing device (FIG. 5, 530) is able to deposit the print agent is referred to as the print zone. Media (FIG. 3, 314) is laid on top of the media transport belt (FIG. 3, 310) which is moved via a series of motors, shafts, gears, and the like. Accordingly, as the media transport belt (FIG. 3, 310) is advanced, the media (FIG. 3, 314) sitting thereon is also advanced towards the print zone.

As the first sheet of media (FIG. 3, 314) approaches the print zone, it may be registered and measured (block 804). Specifically, upon approach, a motor of the printing system (FIG. 5, 528) may lower the blocking device (FIG. 4, 422). The first sheet of media (FIG. 3, 314) is registered in a first direction, which may be a direction perpendicular to the media transport direction, by pressing the media (FIG. 3, 314) against the lowered blocking device (FIG. 4, 422) of the printing system (FIG. 1, 100). The first sheet of media (FIG. 3, 314) is registered in a second, and perpendicular direction, by pressing the media (FIG. 3, 314) against the lowered lateral registration device (FIG. 7, 716). FIG. 10 pictographically depicts the registration of the media (FIG. 3, 314) in these two directions. In an example, the movement of the media (FIG. 3, 314) during registration may be manual, or via action of the media transport belt (FIG. 3, 310) to advance the media.

Figure 11A:
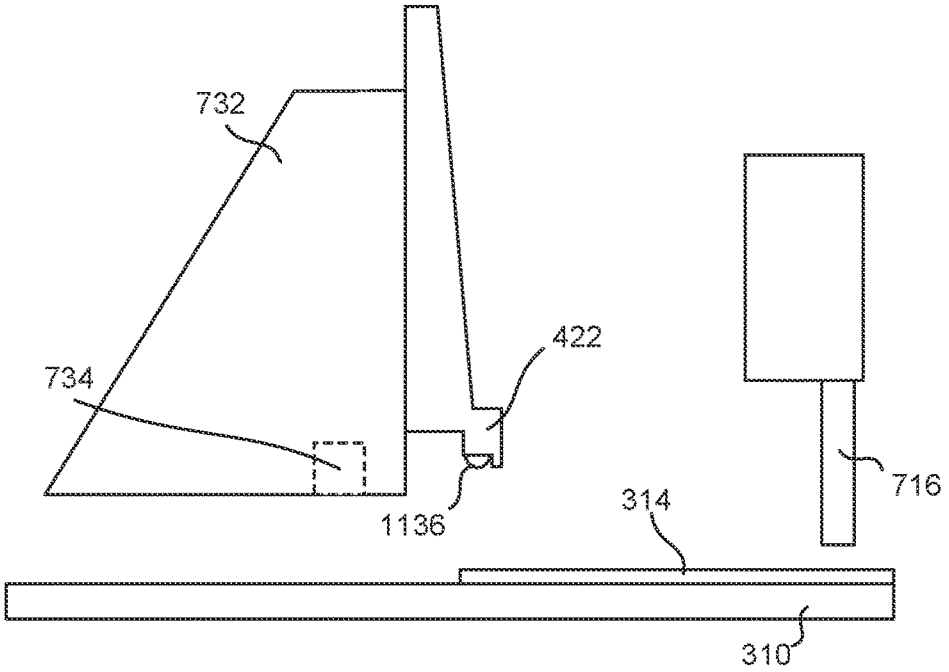
FIGS. 11A and 11B are side views of the measurement of a sheet of media, according to an example of the principles described herein.
Figure 11B:
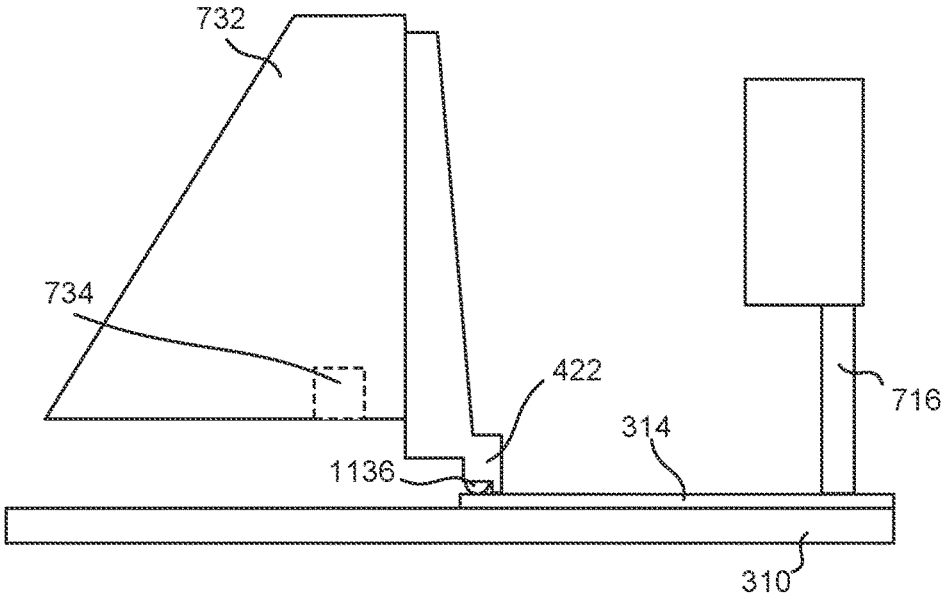

In an example, registering and measuring (block 804) the first sheet of media (FIG. 3, 314) includes measuring the dimensions of the sheet of media (FIG. 3, 314). For example, once the first sheet of media (FIG. 3, 314) has been registered, a motor of the printing system (FIG. 5, 528) may raise the blocking device (FIG. 4, 422) up such that the continuous movement of the media transport belt (FIG. 3, 310) advances the media a bit. At this point, the blocking device (FIG. 4, 422) may be lowered to measure a thickness of the first sheet of media (FIG. 3, 314). That is, the blocking device (FIG. 4, 422) may include a pressure sensor that can detect when it contacts a surface, for example of a sheet of media (FIG. 3, 314). Accordingly, when the pressure sensor contacts the sheet of media (FIG. 3, 314) it can, using a database and recorded datums of the printing system (FIG. 5, 528), determine a thickness of the sheet of media (FIG. 3, 314). FIGS. 11A and 11B depict the measurement of a thickness of the sheet of media (FIG. 3, 314).

Once the thickness of the sheet of media (FIG. 3, 314) is measured, the media (FIG. 3, 314) may be advanced further until it falls under a field of view of sensors (FIG. 7, 734-1, 734-2) which sensors (FIG. 7, 734) may be able to detect edges of the sheet of media (FIG. 3, 314). For example, the sensors (FIG. 7, 734) may be optical sensors that detect differences in coloration and/or reflectance, such as for example a difference between the sheet of media (FIG. 3, 314) which may be a different color and/or reflectance than the media transport belt (FIG. 3, 310) on which it is disposed.

Note that in the production mode, such measuring may be performed one time. That is, when dimensions of all sheets of media (FIG. 3, 314) that are to be printed on for a particular print job are the same, the measurement of the dimensions of one sheet of media (FIG. 3, 314) are indicative of the dimensions of the remaining sheets of media (FIG. 3, 314). Accordingly, this "production mode" conserves printing time by performing such measurements a single time as opposed to doing so for each processed sheet of media (FIG. 3, 314).

Following registration and measurement (block 804), the first sheet of media (FIG. 3, 314) may be printed on. However, it may be the case that a user loads a second sheet of media (FIG. 3, 314) on the loading table (FIG. 3, 312) or the media transport belt (FIG. 3, 310) as the first sheet is being printed on. Accordingly, it may be desirable to block the second sheet of media (FIG. 3, 314) from entering the print zone. However, as described above, if the media is thinner than a gap between the lowered blocking device (FIG. 4, 422) and the media transport belt (FIG. 3, 310), the media (FIG. 3, 314) may unintentionally pass to the print zone. Accordingly, the method (800) includes raising (block 806) the lateral edges of the second sheet of media to interface with a blocking device (FIG. 4, 422) of the printing system (FIG. 5, 528). Specifically, lateral edges, that is edges that are parallel with the direction of media travel, are positioned on media lifting strips (FIG. 1, 102) such that they interface with the lowered blocking device (FIG. 4, 422). As such, the second sheet of media (FIG. 3, 314) is blocked (block 808) from entering the print zone while the first sheet of media is printed on.

Figure 9:
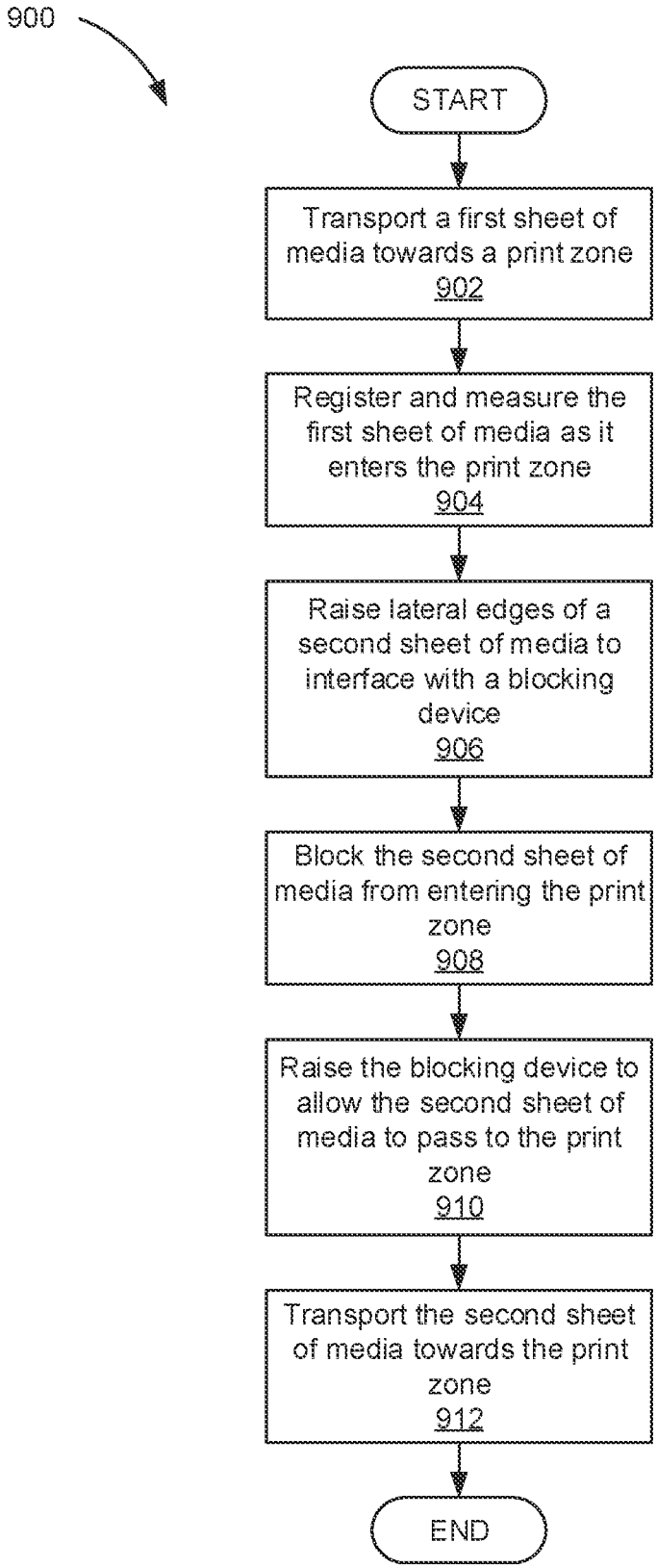
FIG. 9 is a flow chart of a method for lifting edges of media, according to another example of the principles described herein.

FIG. 9 is a flow chart of a method (900) for lifting edges of media (FIG. 3, 314), according to another example of the principles described herein. As described above, the method (900) may include transporting (block 902) a first sheet of media (FIG. 3, 314) towards a print zone and registering and measuring (block 904) the first sheet of media (FIG. 3, 314). These operations may be performed as described above in connection with FIG. 8.

In some examples, while the first sheet of media (FIG. 3, 314) is being printed on, the user may place a second sheet of the media (FIG. 3, 314) on the media transport belt (FIG. 3, 310) and position it for registration. To prevent thin media from sliding under the blocking device (FIG. 4, 422) and potentially interfering with the printing on the first sheet of media (FIG. 3, 314), the lateral edges of the second sheet of media (FIG. 3, 314) are raised (block 906) such that the second sheet is blocked (block 908). These operations may be performed as described above in connection with FIG. 8.

At this point in time, the second sheet of media (FIG. 3, 314) may be registered as described above with regards to the first sheet of media (FIG. 3, 314), that is by contact with the blocking device (FIG. 4, 422) and the lateral registration device (FIG. 3, 316). As described above, without the media lifting device (FIG. 1, 100), rather than pushing the second sheet of media against the blocking device (FIG. 4, 422) for registration, a user or the media transport belt (FIG. 4, 422) may inadvertently slide the second sheet of media (FIG. 3, 314) under the blocking device (FIG. 4, 422). This may move the first sheet of media such that the print agent is not correctly deposited thereon or may introduce the second sheet of media between the first sheet such that print agent that is intended for the first sheet is actually deposited on the second sheet. This may result in both the printing on the first sheet and the second sheet being incorrect, thus resulting in wasted media, print agent, and time.

Responsive to completion of printing on the first sheet of media (FIG. 3, 314), a motor of the printing system (FIG. 5, 528) may raise (block 910) the blocking device (FIG. 4, 422) to allow the second sheet of media to pass under the printing device (FIG. 5, 530). That is, printing may begin on the second sheet of media (FIG. 3, 314). Note that with the first sheet of media, following registration and before printing, the first sheet of media dimensions were measured. In some examples, the method (900) includes transporting (block 912) the second sheet of media (FIG. 3, 314) towards the print zone without measuring the second sheet of media (FIG. 3, 314). This is on account of the measurement having already been performed for the first sheet of media (FIG. 3, 314) and the first and second sheets of media (FIG. 3, 314) having similar dimensions.

FIG. 10 is a top view of the registration of a sheet of media (314), according to an example of the principles described herein. That is, as described above, either manually or via movement by the media transport belt (310), the sheet of media (310) may be pushed against the blocking device (422) as indicated by the arrow (318) thus providing registration in a first direction. The media (314) may also be pushed against the lateral registration device (716) as indicated by the arrow (1020) thus providing registration in a second direction. Again, the movement of the media (314) against this lateral registration device (716) may be automatic via action of the media transport belt (310) or may be via user manipulation. Registration ensures that the image and/or text aligns with the media (310) in an intended fashion. That is, were the media (314) to be skewed, the image and/or text on the media (314) would also be skewed.

FIGS. 11A and 11B are side views of the measurement of a sheet of media (314), according to an example of the principles described herein. As described above, in addition to providing registration of the media (314) in a first direction, the blocking device (422) may also measure a thickness of the media (314). For example, following registration and/or after a first sheet of media has been transported out of the print zone, a motor of the printing system (FIG. 5, 528) may raise the blocking device (422) and the media (314) advanced to be positioned beneath the blocking device (422) as depicted in FIG. 11A. In this example, raising the blocking device (422) may be triggered by a controller of the printing system (FIG. 5, 528) detecting that printheads are inactive, thus indicating that the printing on a sheet of media (314) has finished. FIG. 11A also depicts the scanning carriage (732) that a printing device (FIG. 5, 530) may be coupled and along which the printing device (FIG. 5, 530) may advance to deposit print agent.

As depicted in FIG. 11B, the blocking device (422) may be lowered such that a pressure sensor (1136) or other sensor coupled to the blocking device (422) may detect contact with the media (314). This information along with calibration information, for example information of a position of the media transport belt (310), may allow a controller of the printing system (FIGS. 5, 528) to determine the thickness of the media (314). Following measurement of the thickness, the blocking device (422) may be raised and the media (314) advanced further underneath the scanning carriage to fall underneath the optical sensors (734) which measure a width of the media (314).

That is, as described above, in some examples, the printing system (FIG. 5, 528) in addition to registering the media (314), measures the dimensions of the media (314). Accordingly, in an example, the printing system (528) includes sensors (734) to measure a width of the sheets of media (314). For example, such sensors (734) may be optical sensors that can detect edges of the media (314). In this example, this information may be passed to the printing system (FIG. 5, 528) to alter or adjust operation of the components of the printing device (FIG. 5, 530) and printing system (FIG. 5, 528) in general to ensure high quality and accurate print agent deposition. In FIGS. 11A and 11B, the sensor (734) is depicted in dashed lines to indicate its position internal to the scanning carriage (732). As described above, the measurement operations described in connection with FIGS. 11A and 11B may occur just for the first sheet of media (314).

FIG. 12 is a side view of the media lifting device (100), according to an example of the principles described herein. As described above, the media lifting strip (102) may include an attachment device to affix the media lifting strip to the clamp (104). For example, the attachment device may include slots that fit around posts (1238) in the clamp (104) such that the two components are selectively joined.

FIG. 12 also depicts the attachment of the clamp (104) to the loading table (312). As described above, the media lifting device (100) may be coupled to the loading table (312) such that it may be re-positioned. For example, the clamp (104) may be press fit onto the loading table (312) at a particular location. At a different point in time, a user may remove the clamp (104) from the loading table (312) to re-locate it, based on for example, printing on a media (314) with a different size. As such, a moveable media lifting device (100) facilitates the raising of a media edge, regardless of a size of the media. That is, the media lifting system may be adjusted based on the side of the media (314) being printed on.

Such devices and methods 1) allow for efficient printing of multiple copies of a print job; 2) allow use of a belt printing system on media that may be less thick than a gap between a blocking device and the media transport belt; 3) may be adjustable to simultaneously print any number of instances; and 4) may be adjustable to media of different dimensions. However, it is contemplated that the systems and methods disclosed herein may address other matters and deficiencies in a number of technical areas.

What is claimed is:

1. A media lifting device, comprising:
- a media lifting strip to sit on a media transport belt of a printing system, wherein:
  - the media lifting strip is to raise a lateral edge of incoming media; and
  - the lateral edge is a portion of the incoming media that is parallel to a media travel direction; and
- a clamp to affix the media lifting strip to the printing system.

2. The media lifting device of claim 1, further comprising an aperture in the media lifting strip to allow passage of a lateral registration device, wherein the lateral registration device is to position the incoming media.

3. The media lifting device of claim 1, wherein the clamp is moveable along a loading table of the printing system.

4. The media lifting device of claim 1, wherein the media lifting strip comprises an attachment device to affix the media lifting strip to the clamp.

5. A method, comprising:
- transporting, via a media transport belt, a first sheet of media towards a print zone of a printing system;
- registering and measuring the first sheet of media as it enters the print zone;
- raising a lateral edge of a second sheet of media to interface with a blocking device of the printing system; and
- blocking the second sheet of media from entering the print zone while the first sheet of media is being printed on.

6. The method of claim 5, wherein, responsive to completion of printing on the first sheet of media, raising the blocking device to allow the second sheet of media to pass to the print zone.

7. The method of claim 6, wherein registering and measuring the first sheet of media comprises:
- registering the first sheet of media in a first direction by pressing it against the blocking device of the printing system; and
- registering the first sheet of media in a second direction which is orthogonal to the first direction by pressing it against a descending lateral registration device.

8. The method of claim 5, wherein registering and measuring the first sheet of media comprises:
- lowering the blocking device to measure a thickness of the first sheet of media; and
- measuring with a sensor, a width of the first sheet of media.

9. The method of claim 5, further comprising, transporting, via the media transport belt, the second sheet of media towards the print zone without measuring dimensions of the second sheet of media.

10. A printing system, comprising:
- a loading table to receive sheets of media to be printed on;
- a printing device to deposit a print agent onto the sheets of media;
- a media transport belt on which the sheets of media sit, the media transport belt to move the sheets of media underneath the printing device;
- a blocking device moveable to:
  - prevent a second sheet of media from passing into a print zone while a first sheet is being printed, wherein a gap is maintained between the blocking device and the media transport belt; and
  - allow the second sheet of media to pass into the print zone when the first sheet has been completed; and
- a media lifting device comprising:
  - a media lifting strip to sit on the media transport belt and to raise a lateral edge of incoming media; and
  - a clamp to affix the media lifting strip to the loading table.

11. The printing system of claim 10, wherein the gap between the between the blocking device and the media transport belt is 0.8 millimeters (mm).

12. The printing system of claim 10, wherein a gap between the blocking device and the media lifting strip is 0.1 mm.

13. The printing system of claim 10, wherein the media lifting device comprises multiple media lifting strips and multiple clamps to facilitate simultaneously lifting multiple sheets of media to be printed on in parallel.

14. The printing system of claim 10, further comprising, per media lifting strip, a lowerable lateral registration device.

15. The printing system of claim 10, further comprising a sensor to measure a width of the sheets of media.

* * * * *